US005251661A

United States Patent [19]

Hugues et al.

[11] Patent Number: 5,251,661

[45] Date of Patent: Oct. 12, 1993

[54] REMOTE FILLING DEVICE FOR AN OIL TANK

[75] Inventors: Michel G. Hugues, Bois Le Roi; Gilles C. G. Massot, Le Mee sur Seine, both of France

[73] Assignee: Societe Nationale d'Etude et de Construction de Moteurs d'Aviation S.N.E.C.M.A., Paris, France

[21] Appl. No.: 818,129

[22] Filed: Jan. 8, 1992

[30] Foreign Application Priority Data

Jan. 9, 1991 [FR] France ..... 91 00183

[51] Int. Cl.[5] ..... F01M 11/03; F02C 7/06

[52] U.S. Cl. ..... 137/637.1; 251/149.1; 251/149.5; 141/346; 141/311 R

[58] Field of Search ..... 137/583, 587, 637.1, 137/383, 577, 628, 591; 141/95, 346, 348, 349, 351, 353, 354, 357, 383; 251/149.5; 285/26, 29, 914, 80

[56] References Cited

U.S. PATENT DOCUMENTS 2,710,019 6/1955 Reasoner et al. .
2,718,343 9/1955 Brown .
3,924,708 12/1975 Dabrowka .
4,753,268 6/1988 Palau ..... 285/914
4,883,148 11/1989 Welch .

FOREIGN PATENT DOCUMENTS 2633007 12/1989 France .

OTHER PUBLICATIONS

Manca Interlock For Quick-Release Fluid Couplings vol. II No. 8 Jan. 1969.

*Primary Examiner*—Martin P. Schwadron
*Attorney, Agent, or Firm*—Oblon, Spivak, McClelland, Maier & Neustadt

[57] ABSTRACT

A device for the remote filling of an oil tank, particularly an oil tank of an aircraft engine, is provided with a lock which interconnects the inlet nozzle of the oil filler and the outlet nozzle of excess oil remover so that the oil supply pipe cannot be connected to the inlet nozzle to supply oil to the tank until the removal pipe has been connected to the outlet nozzle of the excess oil remover. The lock includes a locking member which engages in a notch in a slide valve housed in the inlet nozzle to prevent the valve from moving to open the nozzle while a slide valve in the outlet nozzle is closed, but which moves clear of the notch when the outlet nozzle slide valve is opened by connection of the removal pipe to the outlet nozzle.

6 Claims, 3 Drawing Sheets

REMOTE FILLING DEVICE FOR AN OIL TANK

BACKGROUND OF THE INVENTION

1. Field of the Invention

The present invention relates to a device for the remote filling of an oil tank, and is particularly applicable to the oil tanks of aircraft turboshaft engines.

2. Summary of the Prior Art

For safety and size reasons, the oil tanks of aircraft engines are often situated in places which are difficult to access. Filling such a tank must therefore be made from a distance by connecting a supply pipe to a filler hole of the tank. In addition, an excess oil removal pipe is generally connected to the tank. Thus, when the oil reaches a certain level in the tank, it flows along the excess oil removal pipe, thus triggering the closure of the supply pipe.

Such an arrangement is described in documents US-A-2,710,019 and FR-A-2 633 007.

Generally, remote filling oil tanks require a certain sequence to be followed when connecting the pipes. Indeed, when filling such a tank, it is necessary first to connect the excess oil removal pipe along which the oil flows when the tank is full, then the supply pipe, so as to lessen the risk of overfilling the tank.

Several things may occur if this sequence is not followed. Failure to connect the excess oil removal pipe results in the tank being overfilled. Escape of excess oil may then occur along pipes such as the degassing ducting, the role of which is not to permit oil circulation. The consequences of such overfilling are various, depending on the aircraft engine involved, but in particular there is a risk of over-heating and leakage.

It is an object of the present invention therefore to provide a filling device which prevents the connection of the supply pipe when the excess oil removal pipe has not been connected. A further object is for such a device to effect closure of the degassing ducting when the tank is being filled.

SUMMARY OF THE INVENTION

According to the invention, there is provided a device for the remote filling of an oil tank having an internal space for containing the oil, and degassing means, said device being adapted to be attached to said tank and comprising:

remote oil filling means comprising an oil inlet nozzle arranged to be open to said internal space of said tank, a detachable oil supply pipe adapted to be connected to said inlet nozzle, and automatic closure means for said inlet nozzle;

excess oil removal means comprising an outlet nozzle arranged to be open to said internal space of said tank, a detachable removal pipe adapted to be connected to said outlet nozzle, and automatic closure means for said outlet nozzle; and locking means interposed between said automatic closure means for said outlet nozzle and said automatic closure means for said inlet nozzle which prevents connection of said oil supply pipe to said inlet nozzle when said removal pipe is not connected to said outlet nozzle.

Preferably, the automatic closure means for said inlet nozzle comprises an inlet slide valve slidably mounted in said inlet nozzle, and first resilient means normally maintaining said inlet slide valve in a position closing said inlet nozzle, connection of said supply pipe to said inlet nozzle moving said inlet slide valve into an open position.

Similarly, the automatic closure means for the outlet nozzle preferably comprises an outlet slide valve slidably mounted in said outlet nozzle, and second resilient means normally maintaining said outlet slide valve in a position closing said outlet nozzle, connection of said removal pipe to said outlet nozzle moving said outlet slide valve into an open position.

In a preferred embodiment of the invention, the locking means comprises a locking member and third resilient means biassing said locking member into engagement with said outlet slide valve, said locking member occupying a position wherein it locks said inlet slide valve in its closed position when said removal pipe is not connected to said outlet nozzle, and said locking member occupying a position wherein said inlet slide valve is free to move to its open position when said removal pipe is connected to said outlet nozzle.

Preferably, the locking member is a slidably mounted member having a first end which fits into a notch in the inlet slide valve when the inlet and outlet slide valves are in their closed positions, and a second end which is held in engagement with a cam surface of the outlet slide valve by the action of said third resilient means, said cam surface allowing said locking member to move so that said first end moves out of said notch when said outlet slide valve is moved to its open position by connection of said removal pipe to said outlet nozzle.

Preferably, the inlet slide valve has transverse passage means enabling air to flow between the internal space of the tank and the degassing means when the inlet slide valve is in the closed position. However, when the inlet slide valve is in the open position, the transverse passage means is closed and access to the degassing means from the interior of the tank is impossible.

The device in accordance with the invention enables the overfilling of a remotely filled oil tank to be avoided.

Other features and advantages of the invention will become apparent from the following description of a preferred embodiment, given by way of example and with reference to the accompanying drawings.

DESCRIPTION OF THE PREFERRED EMBODIMENT

Figure 1:
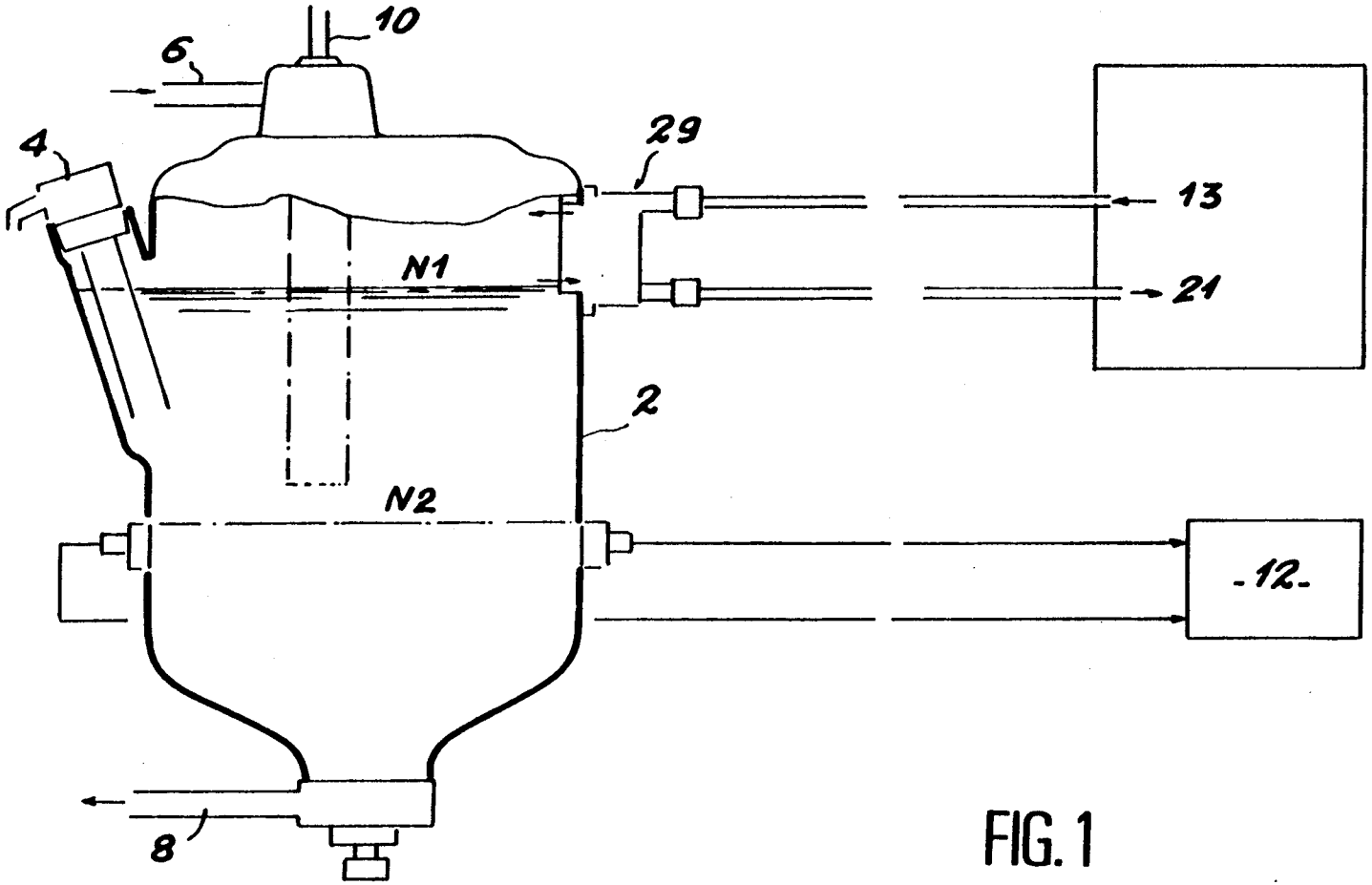
FIG. 1 is a diagrammatic view of an aircraft engine oil tank to which a remote filling device in accordance with the invention is fitted.

The oil tank 2 shown in FIG. 1 comprises an internal space for containing oil, into which opens an oil inlet duct 4 for manual filling, an inlet duct 6 for oil coming from a used oil recovery system (not shown), and an outlet duct 8 for the delivery of oil to an engine supply circuit (not shown).

Also opening into the upper part of the tank 2 is a degassing pipe 10 for the flow of air between the inside of the tank 2 and a degassing device which is not shown.

A low level detection device 12, partly situated in the lower part of the tank 2 is provided for detecting when the oil in the tank reaches a minimum level N2 necessary for a suitable supply to the engine supply circuit to be maintained.

The remote filling device 13,21,29 of the invention is fitted to the upper part of the tank 2, close to the desired maximum oil level N1 in the tank space.

Figure 2:
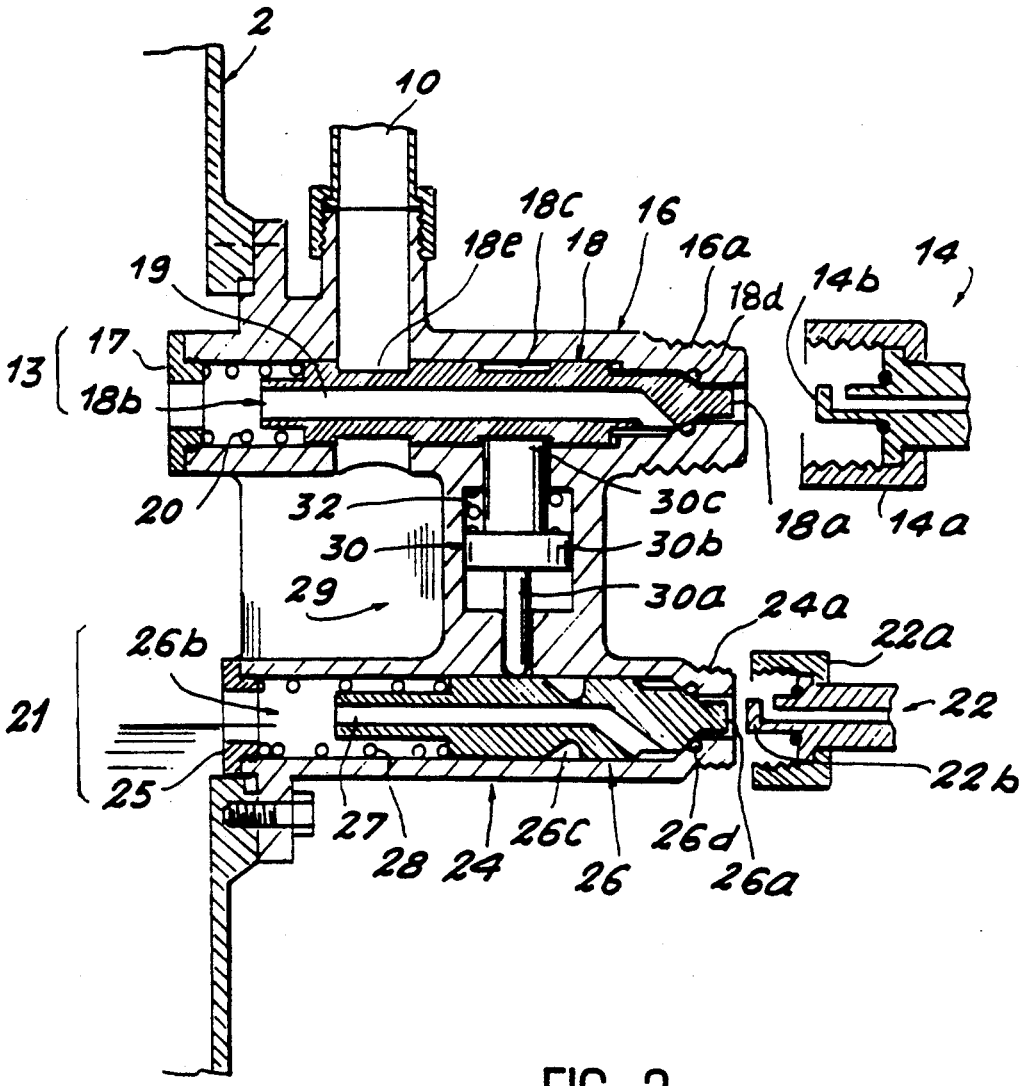
FIG. 2 is a sectional view of a preferred embodiment of the remote filling device of the invention fitted to an oil tank.

A preferred embodiment of the filling device of the invention is shown in FIG. 2. The device comprises an inlet nozzle 16 and an overflow outlet nozzle 24 which are open to the tank space and are interconnected by a locking device 29. The inlet nozzle 16 is situated above the outlet nozzle 24, the axes of the two nozzles being horizontal.

The inlet nozzle 16 has a threaded end 16*a* for the connection of an oil supply pipe 14. The supply pipe 14 has a coupling sleeve 14*a* which is arranged to be screwed onto the threaded end 16*a* of the inlet nozzle 16, and the supply pipe 14 is thus detachable from the nozzle 16.

An inlet slide valve 18 is slidably mounted inside the inlet nozzle 16. The slide valve 18 is of a cylindrical shape and has, at an end thereof adjacent the threaded end 16*a* of the inlet nozzle 16, a portion 18*a* of smaller diameter forming a shoulder which normally acts through a seal 18*d* on a complementary shoulder formed inside the nozzle 16 under the action of a compression spring 20. This spring 20 is enclosed between the end 18*b* of the inlet slide valve 18 opposite its end 18*a* and a support member 17 fixed on the inlet nozzle 16.

A passage 19 is formed through the slide valve 18 between the end 18*b* and a portion of its periphery positioned rearwardly from the seal 18*d* relative to the end 18*a* of the valve. The spring 20 normally urges the slide valve 18 to a closed position in which the passage 19 does not communicate with the opening through the threaded end 16*a* of the inlet nozzle 16. However, when the supply pipe 14 is connected to the nozzle 16 by the sleeve 14*a*, a protruding part 14*b* at the end of the supply pipe 14 pushes the slide valve 18 back against the action of the spring 20, and the passage 19 then communicates with the opening through the threaded end of the inlet nozzle 16 to permit the flow of oil into the tank 2.

The inlet slide valve 18 also has a notch 18*c* formed by a peripheral annular groove around its mid portion.

In addition, the inlet slide valve 18 has a transverse passage 18*e* which normally (i.e. when the slide valve 18 is in the closed position) ensures the flow of air between the inside of the tank 2 and the degassing pipe 10, the latter being connected to a degassing system which is not shown in the drawing. In the open position of the slide valve 18, i.e. when remote filling of the tank 2 is taking place, the transverse passage 18*e* is displaced towards the support member 17 so that air is prevented from flowing through the passage 18*e* to the degassing pipe 10. Since this air passage is then blocked, in the unlikely event of overfilling the tank, oil could not escape along the degassing pipe 10 to cause the effects mentioned earlier. In addition, since the ability of air to escape during filling is reduced, the return of oil through the overflow pipe is effected at higher speed.

In a manner similar to that of the inlet nozzle 16, the outlet nozzle 24 has a threaded end 24*a* for the connection of a removal pipe 22 for the overflow oil. This removal pipe 22 is detachable, having a coupling sleeve 22*a* at its end which is arranged to be screwed on the threaded end 24*a* of the outlet nozzle 24.

An outlet slide valve 26 is slidably mounted inside the outlet nozzle 24. This outlet slide valve 26 is of a cylindrical shape and has, at its end adjacent the threaded end 24*a* of the outlet nozzle 24, a portion 26*a* of smaller diameter forming a shoulder which normally acts through a seal 26*d* on a complementary shoulder formed inside the nozzle 24 under the action of a compression spring 28. This spring 28 is enclosed between the end 26*b* of the outlet slide valve 26 opposite its end 26*a* and a support member 25 fixed to the outlet nozzle 24.

A passage 27 is formed through the slide valve 26 between its end 26*b* and a portion of its periphery situated rearwardly from the seal 26*d* relative to the end 26*a* of the valve. The spring 28 normally urges the slide valve 26 to a closed position, in which the passage 27 does not communicate with the opening through the threaded end 24*a* of the outlet nozzle 24. However, when the removal pipe 22 is connected to the nozzle 24 by the sleeve 22*a*, a protruding part 22*b* of the end of the removal pipe 22 pushes the slide valve 26 back against the action of the spring 28, and the passage 27 then communicates with the opening through the threaded end 24*a* of the outlet nozzle to permit the overflow of oil from the tank 2.

The outlet slide valve 26 is provided with a peripheral annular cam surface 26*c* at is mid portion.

The locking device 29 comprises a locking member 30 which is slidably mounted transversely to the axes of the inlet and outlet nozzles 16,24 and which interacts with the slide valves 18 and 26 in a manner dependent on their positions.

The locking member 30 is in the form of a cylindrical peg having three adjacent parts of different diameters: a first part 30*a* forming a stem which bears on the cam surface 26*a* of the outlet slide valve 26; a second part 30*b* in the form of a circular plate overhanging the first part 30*a*; and a third part 30*c* which has a diameter intermediate that of the first part 30*a* and that of the second part 30*b*, and which is able to fit into the notch 18*c* in the side of the inlet slide valve 18. A compression spring 32 is positioned around the third part 30*c* of the locking member 30, and acts between the second part 30*b* and the inlet nozzle 16 to ensure that the first part 30*a* of the locking member bears on the cam surface 26*c* of the outlet slide valve 26.

When the outlet slide valve 26 moves to its open position, the first part 30*a* of the locking member 30 moves into contact with the part of the cam surface 26*c* of least diameter, and the third part 30*c* of the locking member 30 thus moves clear of the notch 18*c* in the inlet slide valve 18.

Figure 3A:
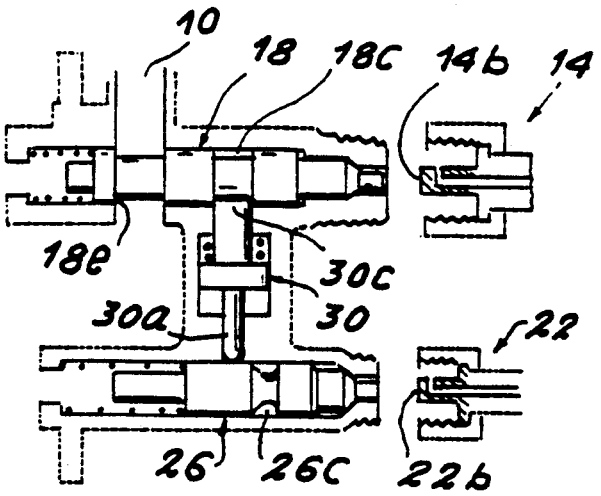
FIGS. 3A, 3B and 3C are diagrammatic views of the device of FIG. 2 showing the device in different operating positions.
Figure 3B:
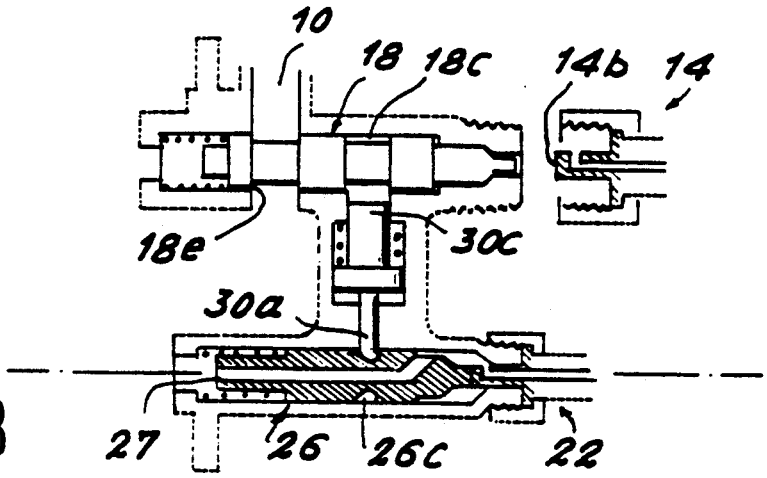
Figure 3C:
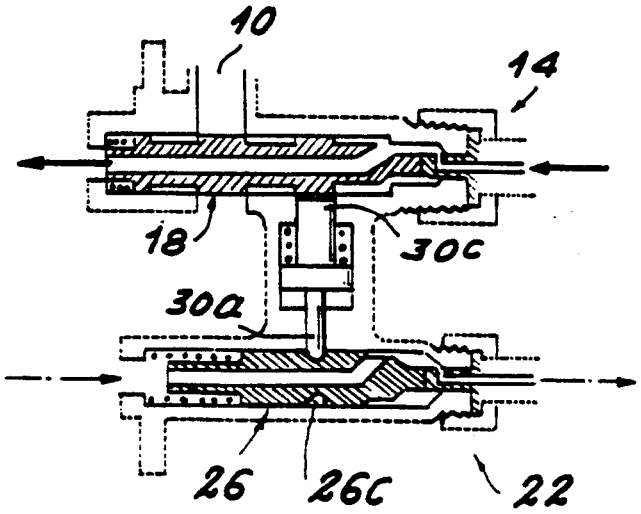

FIGS. 3A,3B and 3C show the three main operative positions which the device may occupy.

FIG. 3A shows the device in its normal or rest state, i.e. when remote filling is not taking place. In this state the compression springs 20 and 28 are in the expanded position and both the inlet and the outlet slide valves 18 and 26 are in the closed position. The first part 30*a* of the locking member 30 thus bears on the part of the cam surface 26*c* of greater diameter, and the third part 30*c* of the locking member 30 is engaged in the notch 18*c* of the inlet slide valve 18. The inlet slide valve 18 is thus locked in the closed position, and connection with the supply pipe 14 is impossible. Also, the transverse passage 18*e* is open to ensure the flow of air to the degassing pipe 10.

FIG. 3B shows the device when the removal pipe 22 has been connected to the outlet nozzle 24. The connection of the pipe 22 results in the movement of the outlet slide valve 26 to its open position, thus compressing the spring 28. When the slide valve 26 moves from the closed position to the open position, the first part 30*a* of the locking member 30 slides over the cam surface 26*c* and into the part of least diameter, thus retracting the third part 30 *c* of the locking member 30 out of the notch 18*c* of the inlet slide valve 18. The inlet slide valve 18 is thus unlocked.

FIG. 3C shows the device when both the supply and removal pipes 14 and 22 are connected to their respective nozzles 16 and 24. When the removal pipe 22 is connected and the inlet slide valve 18 is unlocked as explained above, the connection of the supply pipe 14 may be effected without any problems. The result of this connection is the pushing of the inlet slide valve 18 into its open position, thus compressing the spring 20 and shutting off the transverse passage 18*e*. Oil is then free to flow into the tank in order to fill the tank, and any overflow is able to flow out through the outlet nozzle and removal pipe 22. Furthermore, in the event of an oil overfill, the oil is prevented from flowing out through the degassing duct 10.

It will be clear from these last three figures that the connection of the supply pipe 14 is impossible as long as the inlet slide valve 18 is locked in the closed position, that is to say as long as the outlet slide valve 26 is closed and the locking member 30 is maintained in engagement with the notch 18*c* by the cam surface 26.

We claim:

1. A device for the remote filling of an oil tank having an internal space for containing the oil, and a degasser, said device being adapted to be attached to said tank and comprising:

a remote oil filler comprising an oil inlet nozzle arranged to be open to said internal space of said tank, a detachable oil supply pipe adapted to be connected to said inlet nozzle, and an automatic closer for said inlet nozzle;

an excess oil remover comprising an outlet nozzle arranged to be open to said internal space of said tank, a detachable removal pipe adapted to be connected to said outlet nozzle, and an automatic closer for said outlet nozzle; and a lock interposed between said automatic closer for said outlet nozzle and said automatic closer for said inlet nozzle which prevents connection of said oil supply pipe to said inlet nozzle when said removal pipe is not connected to said outlet nozzle..

2. A device according to claim 1, wherein said automatic closer for said inlet nozzle comprises an inlet slide valve slidably mounted in said inlet nozzle, and a first resilient member for normally maintaining said inlet slide valve in a position closing said inlet nozzle, wherein connection of said supply pipe to said inlet nozzle causes said inlet slide valve to move into an open position.

3. A device according to claim 2, wherein said automatic closer for said outlet nozzle comprises an outlet slide valve slidably mounted in said outlet nozzle, and a second resilient member for normally maintaining said outlet slide valve in a position closing said outlet nozzle, wherein connection of said removal pipe to said outlet nozzle causes said outlet slide valve to move into an open position.

4. A device according to claim 3, wherein said lock comprises a locking member and third resilient member for biassing said lock into engagement with said outlet slide valve, said lock occupying a position for locking said inlet slide valve in a closed position when said removal pipe is not connected to said outlet nozzle, and said lock occupying a position wherein said inlet slide valve is free to move to its open position when said removal pipe is connected to said outlet nozzle.

5. A device according to claim 4, wherein said inlet slide valve is provided with a notch and said outlet slide valve is provided with a cam surface, said lock having a first end which fits into said notch of said inlet slide valve when said inlet slide valve and outlet slide valve are in their closed positions, and said lock having a second end maintained in engagement with said cam surface of said outlet slide valve by the action of said third resilient member, said cam surface allowing said lock to move so that said first end moves out of said notch when said outlet slide valve is moved to its open position by connection of said removal pipe to said outlet nozzle.

6. A device according to claim 2, which comprises an oil tank wherein said inlet slide valve has a transverse passage for ensuring a path for air between said internal space of said tank and said degasser when said inlet slide valve is in its closed position.

* * * * *